US005863249A

United States Patent [19]

Inoue

[11] Patent Number: 5,863,249

[45] Date of Patent: Jan. 26, 1999

[54] CONTROL METHOD AND DEVICE FOR STOPPING A REEL

[75] Inventor: Haruo Inoue, Tokyo, Japan

[73] Assignee: Eagle Co., Ltd., Tokyo, Japan

[21] Appl. No.: 859,103

[22] Filed: May 20, 1997

[51] Int. Cl.[6] ..... G07F 17/34

[52] U.S. Cl. ..... 463/20; 273/143 R; 463/22

[58] Field of Search ..... 273/143 R, 138.2; 463/20, 22

[56] References Cited

U.S. PATENT DOCUMENTS

| | | | |
|---|---|---|---|
| 4,790,537 | 12/1988 | Smyth et al. | 273/143 R |
| 5,209,479 | 5/1993 | Nagao et al. | 273/143 R |
| 5,524,888 | 6/1996 | Heidel | 463/22 |

FOREIGN PATENT DOCUMENTS

| | | | |
|---|---|---|---|
| 2248712 | 4/1992 | United Kingdom | 273/138.2 |

*Primary Examiner*—Benjamin H. Layno
*Attorney, Agent, or Firm*—Young & Thompson

[57] ABSTRACT

Eight character symbols, all of equal pitch, and two blank symbols are arranged on a reel in a rotational direction thereof. As to each of the eight character symbols, one stop position is set so as to stop the center of the character symbol at a winning line. As to each of the two blank symbols, three stop positions are set. One of the three stop positions is selected on the basis of a random number and the blank symbol is stopped at the selected stop position. Accordingly, although the number of equally spaced symbols is ten, fourteen stop positions are obtained. The reel is rotated by a step motor. The stop position is determined according to the number of drive pulses supplied to the step motor.

14 Claims, 4 Drawing Sheets

CONTROL METHOD AND DEVICE FOR STOPPING A REEL

BACKGROUND OF THE INVENTION

1. Field of the Invention

The present invention relates to a control method and device for stopping a reel on which a plurality of symbols including blank symbols are arranged in rotational direction.

2. Description of the Related Art

A slot machine has a plurality of, generally three, four or five, reels built in. Various symbols are arranged on a peripheral surface of the reel. In a stopped state of the reel, at least one of the symbols is adapted to be observed through a symbol display window relative to each reel. Upon starting a game, three reels are simultaneously rotated. When all of reels are stopped by a player's operation of a stop button or by an automatic stop mechanism, presence of winning and kind of winning are determined in accordance with a combination of symbols displayed in the symbol display window.

On the reel, character symbols and blank symbols are arranged at constant pitch. The character symbol has a letter pattern or a character pattern, for example, "7", "BAR" and "cherry". The blank symbol does not have any pattern. As shown in FIG. 4, such a reel is manufactured by sticking a symbol sheet 3 on an outer periphery of a reel main body 2 assembled in cylindrical frame form. The symbol sheet 3 is a strip-like sheet having the identical length L with peripheral length of the reel main body 2. Various symbols are printed on the symbol sheet 3 at constant pitch P. The symbol sheet 3 is stuck to the reel main body 2 such that top of the symbol sheet 3 is adjusted to a predetermined home position index S.

The reel main body 2 is directly connected to a drive shaft of a step motor 5. The step motor 5 is rotated according to the number of drive pulses supplied thereto. The number of drive pulses is counted by a counter 6. The reel main body 2 is provided with a light-shielding tab 7 adjusted to the home position index S. The passage of the light-shielding tab 7 is detected by a photo-interrupter 8 while the reel is rotated. The photo-interrupter 8 outputs a detection signal every detection of the light-shielding tab 7. The detection signal is inputted to the counter 6 as a reset pulse, thereby counted value of the counter 6 is reset to zero once a rotation.

When the step motor 5 is rotated by 1.8 degree relative to input of one drive pulse, two hundred drive pulses are required to make a rotation of the reel. And when ten symbols are arranged on the reel, twenty drive pulses are required to rotate the reel by one symbol. It is preferable to display the symbol such that the center of the symbol is substantially adjusted to a winning line when the reel is stopped. Ten drive pulses are required to rotate the reel by an interval $\alpha$ from the home position index S to the center of first symbol "7". If a position at which the photo-interrupter 8 is set coincides with a position of the winning line, the center of the first symbol "7" is stopped at the winning line by stopping the reel when the counted value of the counter 6 is ten.

Accordingly, in order to stop the center of the Nth symbol of the symbol sheet 3 at the winning line, the drive pulses are supplied to the step motor 5 such that the counted value of the counter 6 becomes "20N-10". In the foregoing description, the position of the winning line is adapted to coincide with the setting position of the photo-interrupter 8 for the sake of convenience. However, if the stop position of the step motor 5 is set taking a gap between the position of the winning line and the setting position of the photo-interrupter into account, it is not necessary to adjust the positions thereof.

When the symbol sheet 3 shown in FIG. 4 is used, if the symbol "7" is provided as one among ten symbols, the probability of the symbol "7" stopping at the winning line is 1/10. In case of changing the probability, the number of symbols "7" should be increased or the number of all symbols should be increased or decreased. Anyway it is required to change the symbol sheet to another one. Particularly, in case of reducing the probability of the symbol "7" to less than 1/10, the number of all symbols must be increased. According to that, stop positions of the step motor 5 must be reset. The operation of resetting the stop position is troublesome. In any case, for changing the appearance probability of the symbol, there arises a problem that changing operation is troublesome.

The appearance probability of specific symbol may be determined by software without regard to number of symbols arranged on the symbol sheet. When reel stopping control is performed such as to stop the symbol selected on the basis of the probability determined by software at the winning line, a difficult hardware change is not required. However, the appearance probability of the specific symbol determined by software would then have no relation with that of the physical reel. In other words, although the appearance probability of the symbol "7" is 1/10 relative to physical reel, it may be changed to any value, for example 1/15, by software. In such a manner, the number of stop positions determined by software does not coincide with that of the physical reel. That is not preferable.

SUMMARY OF THE INVENTION

In view of the foregoing, it is a primary object of the present invention to provide a control method and device for stopping a reel in which the number of stop positions of the reel may be increased without changing a symbol sheet.

It is a second object of the present invention to provide a control method and device for stopping a reel in which the appearance probability of any symbol may be regulated in a simple manner.

In order to achieve the above and other objects, the control device for stopping a reel comprises character symbol stopping means and blank symbol stopping means.

There are arranged character symbols and blank symbols on the reel in a rotational direction. For the character symbol, one stop position is predetermined. And for the blank symbol, a plurality of stop positions are predetermined in the rotational direction of the reel. The character symbol stopping means stops the character symbol at the stop position. The blank symbol stopping means stops the blank symbol at one of the stop positions.

In a preferred embodiment, the character symbol stopping means stops the character symbol in a state that the center of the character symbol coincides with a winning line provided on a symbol display window. The blank symbol stopping means stops the blank symbol in a state so that one of the plural stop positions thereof coincides with the winning line. The plural positions are set in rotational direction of the reel and biased to the center of the blank symbol.

The reel is connected to a step motor. The step motor rotates the reel according to drive pulses supplied thereto. In other words, rotation of the reel is controlled on the basis of the drive pulses and the reel is stopped at a position corresponding to the number of drive pulses supplied to the step motor. The character symbol stopping means and the blank symbol stopping means watch the number of supplied drive pulses to stop the symbol determined by a random number at the winning line.

According to the present invention, the number of stop positions of the reel may be increased by setting a plurality of stop positions for the blank symbol without giving unnatural feeling to the player. Thus, appearance probability of a specific symbol may be regulated in simple manner so that it is not necessary to change a symbol sheet or the like for changing the appearance probability of the specific symbol. Moreover, the probability of winning may also be regulated in simple manner.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 2:
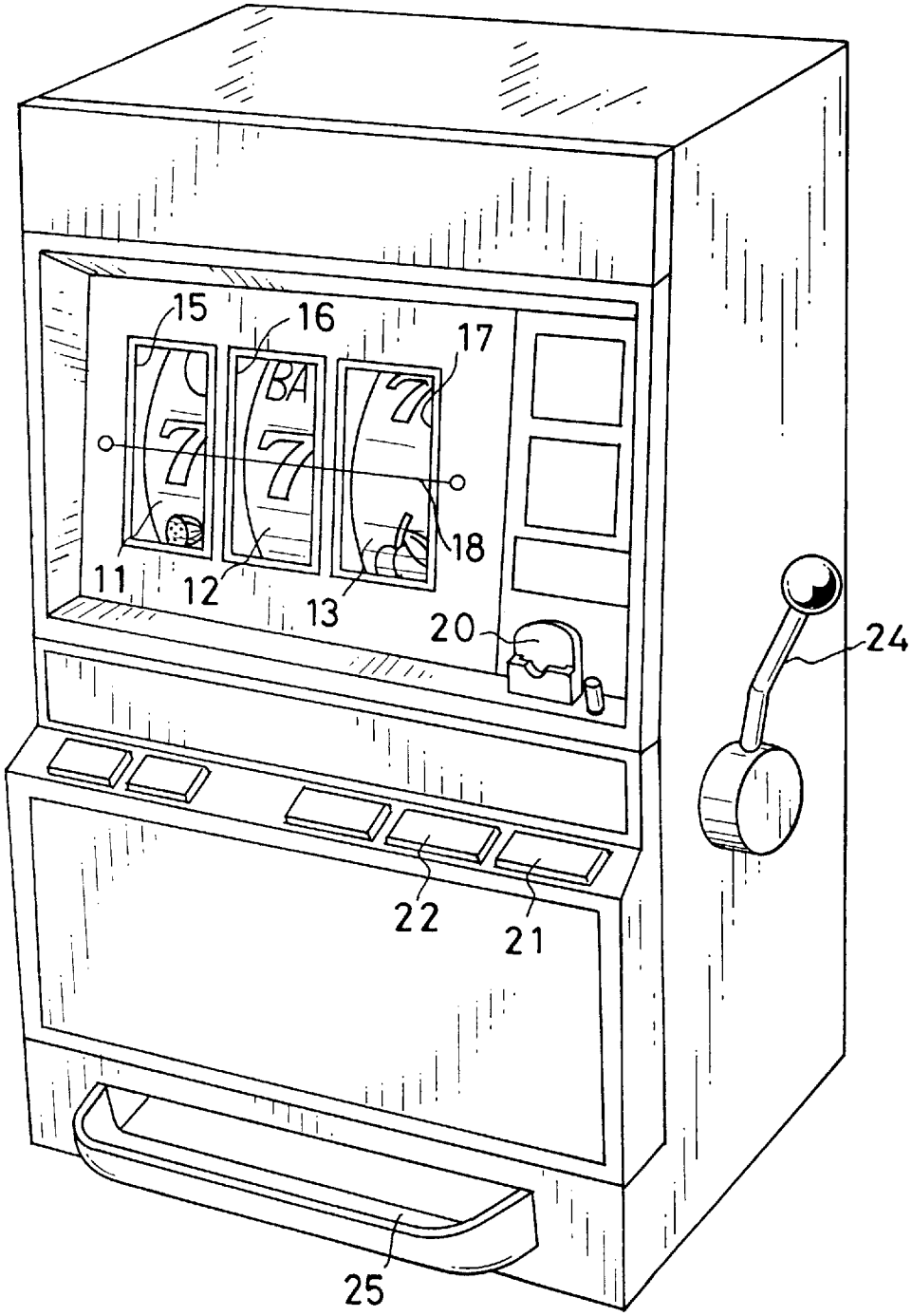
FIG. 2 is a perspective view illustrating an external appearance of a slot machine according to the present invention.

In FIG. 2 showing an external appearance of a slot machine, a front panel is provided with symbol display windows 15, 16 and 17 corresponding to three reels 11, 12 and 13 respectively. A winning line 18 is provided so as to cross the center of the symbol display windows 15 to 17. When the reels are stopped, presence of winning and kind of winning are determined in accordance with a combination of symbols arranged at the winning line 18. When the symbol display windows 15 to 17 are small such as to display only one symbol per reel, the winning line 18 may be omitted.

The front panel is provided with a coin inlet 20 and operation buttons, for example, a credit-play button 21 and a reward-credit button 22. Further, a start lever 24 is also provided on the side of the front panel. Before starting the game, a player puts a coin or coins (including tokens) into the coin inlet 20. According to the number of inserted coins, number of coins paid out in case of winning is changed. If the player puts many coins into the coin inlet 20 beforehand, the player can start the game by pressing the credit-play button 21 instead of putting the coins into the coin inlet 20. In this case, the number of credited coins is reduced every game. The player can recognize the remaining number of credited coins by an indicator. Further, in this case, for each win, the number of coins corresponding to the winning is added to the remaining number of credited coins. The credited coins are paid out on a tray 25 upon pressing the reward-credit button 22.

Figure 1:
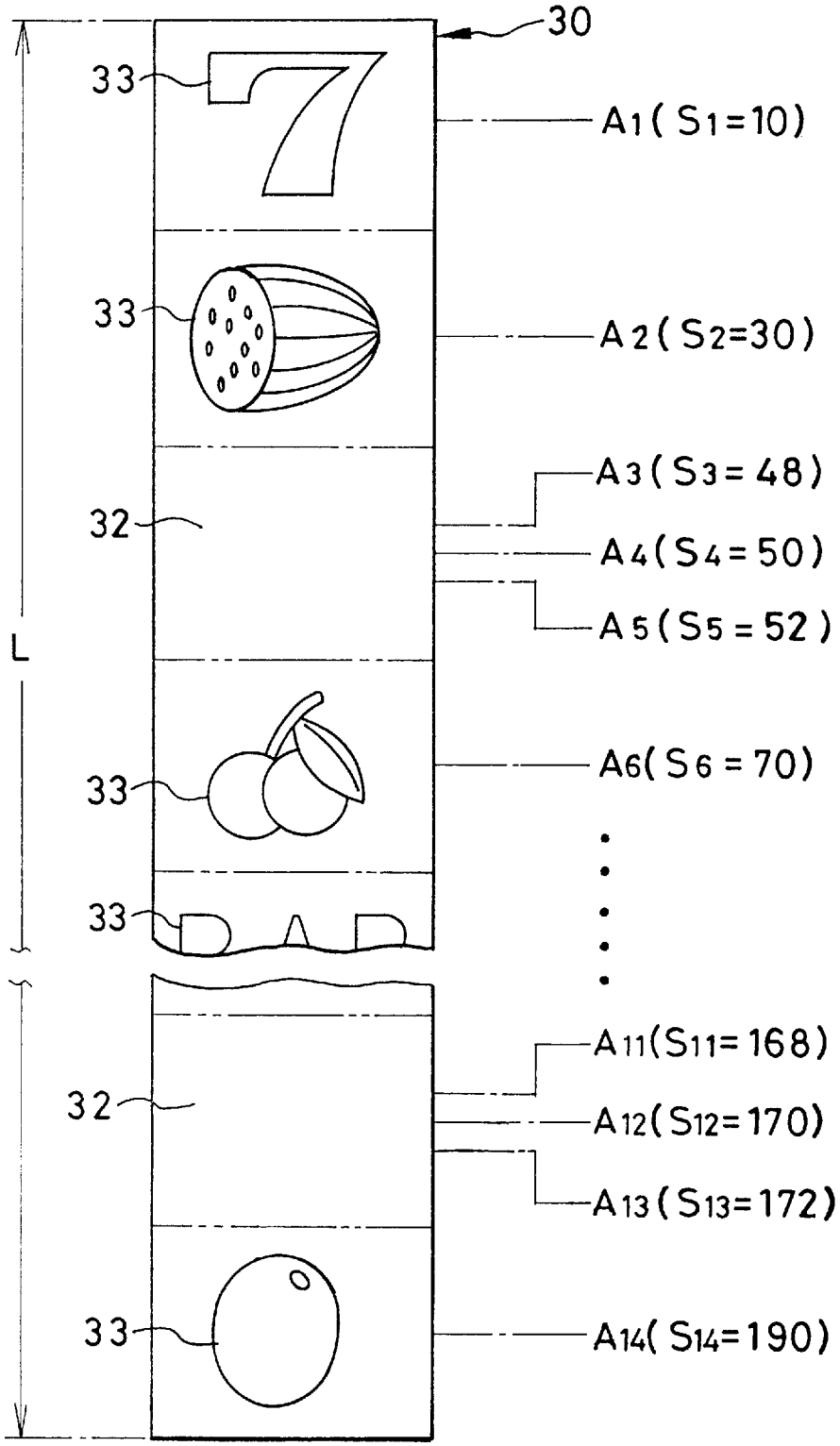
FIG. 1 is a development illustrating an embodiment of a symbol sheet according to the present invention.

Reels 11, 12 and 13 are respectively manufactured by sticking a reel sheet to a reel main body. The reels are similar to that shown in FIG. 4. Developed symbol sheet 30 used for the reel 11 is shown in FIG. 1. The symbol sheet 30 has a length L that is the same as a peripheral length of the reel main body and is provided with character symbols 33, for example "7", "BAR" and "cherry", besides two blank symbols 32. In other words, ten symbols are arranged on the symbol sheet 30 at constant pitch P. Symbol sheets used for other reels 12 and 13 are similar to the symbol sheet 30, however, the kinds and arrangement of symbols are different each other.

Figure 4:
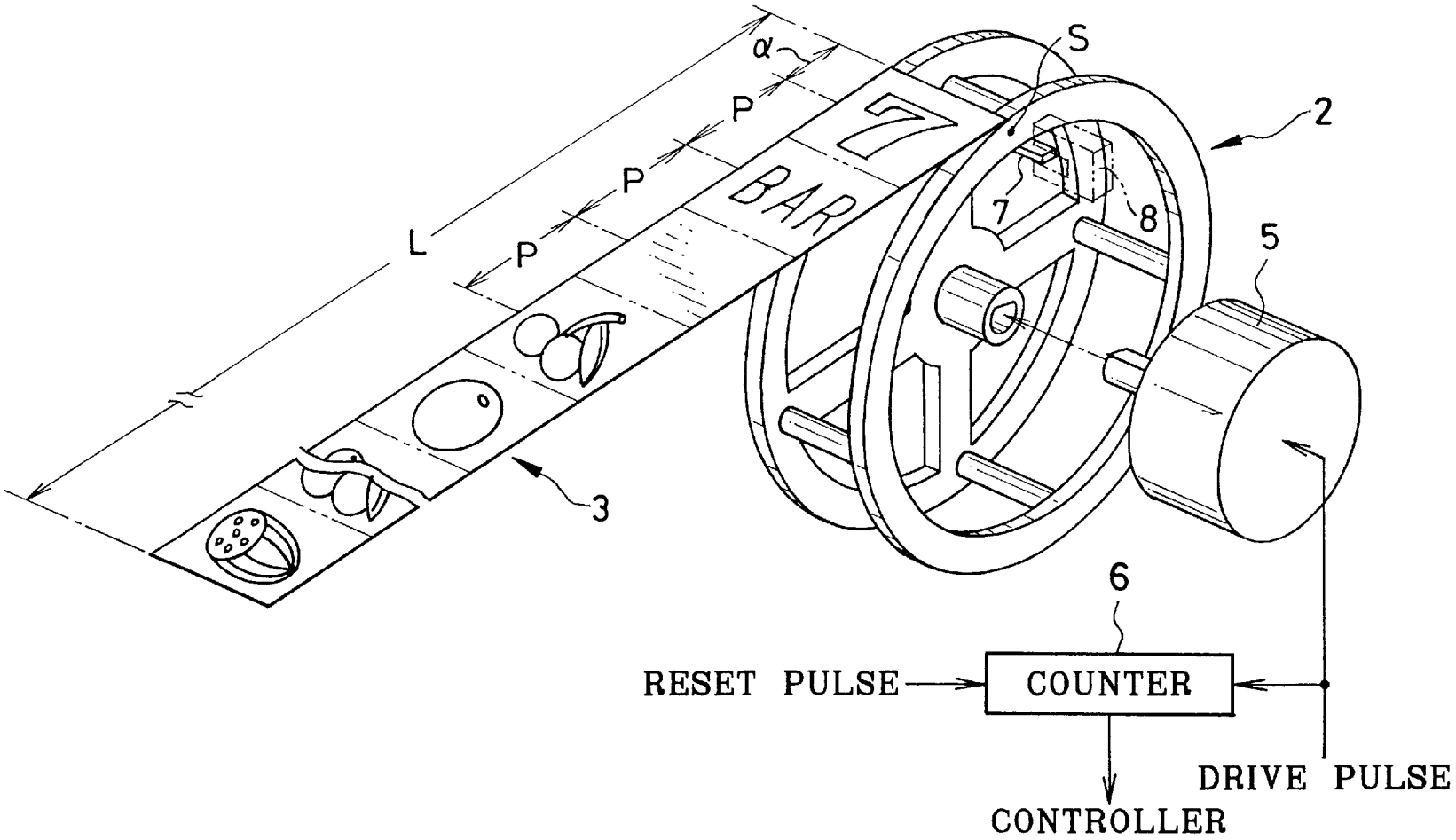
FIG. 4 (PRIOR ART)
FIG. 4 is a schematic illustration showing a reel of a conventional slot machine.

The reel 11 on which the symbol sheet 30 is attached is connected to a step motor like FIG. 4 shows. The reel 11 makes a rotation when two hundred drive pulses are supplied to the step motor. When the reel 11 is stopped in a state that the number SN of supplied drive pulses is ten, namely S1=10, the center of the first character symbol "7" coincides with the winning line 18. In other words, position A1 of the first character symbol "7" shown in FIG. 1 coincides with the winning line 18. When the reel 11 is stopped in a state that the number SN of supplied drive pulses is thirty, namely S2=30, center of second character symbol "watermelon", namely position A2, coincides with the winning line 18. In such a manner, when the reel 11 is stopped in a state that the number SN of supplied drive pulses is satisfied with SN=20N-10, the center of a blank symbol or a character symbol coincides with the winning line 18. By the way, in the above description, the number of drive pulses for making a rotation of the reel is two hundred. However, this is not exclusive. The number of drive pulses for making a rotation may be changed according to the step angle of the step motor.

As to each of the character symbols 33, only one stop position is set. In this embodiment, the character symbol 33 is stopped in a state that the center thereof coincides with the winning line 18. On the other hand, with respect to one of two blank symbols 32, three stop positions are set. The blank symbol 32 is stopped in a state that one of three positions A3, A4 and A5 coincides with the winning line 18. The position A4 is set at the center of the blank symbol 32 and the positions A3 and A5 are respectively located at front and rear of the position A4 relative to the rotational direction of the reel. Similarly, with respect to the other of the two blank symbols 32, positions A11 and A13 are set beside a position A12 as stop positions. As hereinafter described, in order to stop the reel 11 at the positions A3, A5, A11 and A13, corresponding number of drive pulses, for example S3=48, S5=52, S11=168 and S13=172, are supplied to the step motor respectively.

As to the number SN of drive pulses determining the positions A3, A5, A11 and A13, it is possible to set numbers such as S3=45, S5=55, S11=165 and S13=175. However, when the reel is stopped such that the position A3 corresponding to S3=45 coincides with the winning line 18, an adjacent character symbol ("watermelon" in FIG. 1) is stopped closely to the winning line 18. In this case, the player may judge that the character symbol is stopped at the winning line 18. To avoid this, it is preferable to bias the positions A3 and A5 near the position A4 set at the center of the blank symbol 32. Similarly, it is preferable to bias the positions A11 and A13 near the position A12. In this meaning, the positions A3, A5, A11 and A13 may be also set such as S3=49, S5=51, S11=169 and S13=171.

When two stop positions are set relative to the blank symbol 32, it is preferable that two numbers of drive pulses corresponding to the two stop positions may be 49 and 50, 50 and 51 or 49 and 51. In such a way, the adjacent character symbol is prevented from stopping near the winning line 18.

Figure 3:
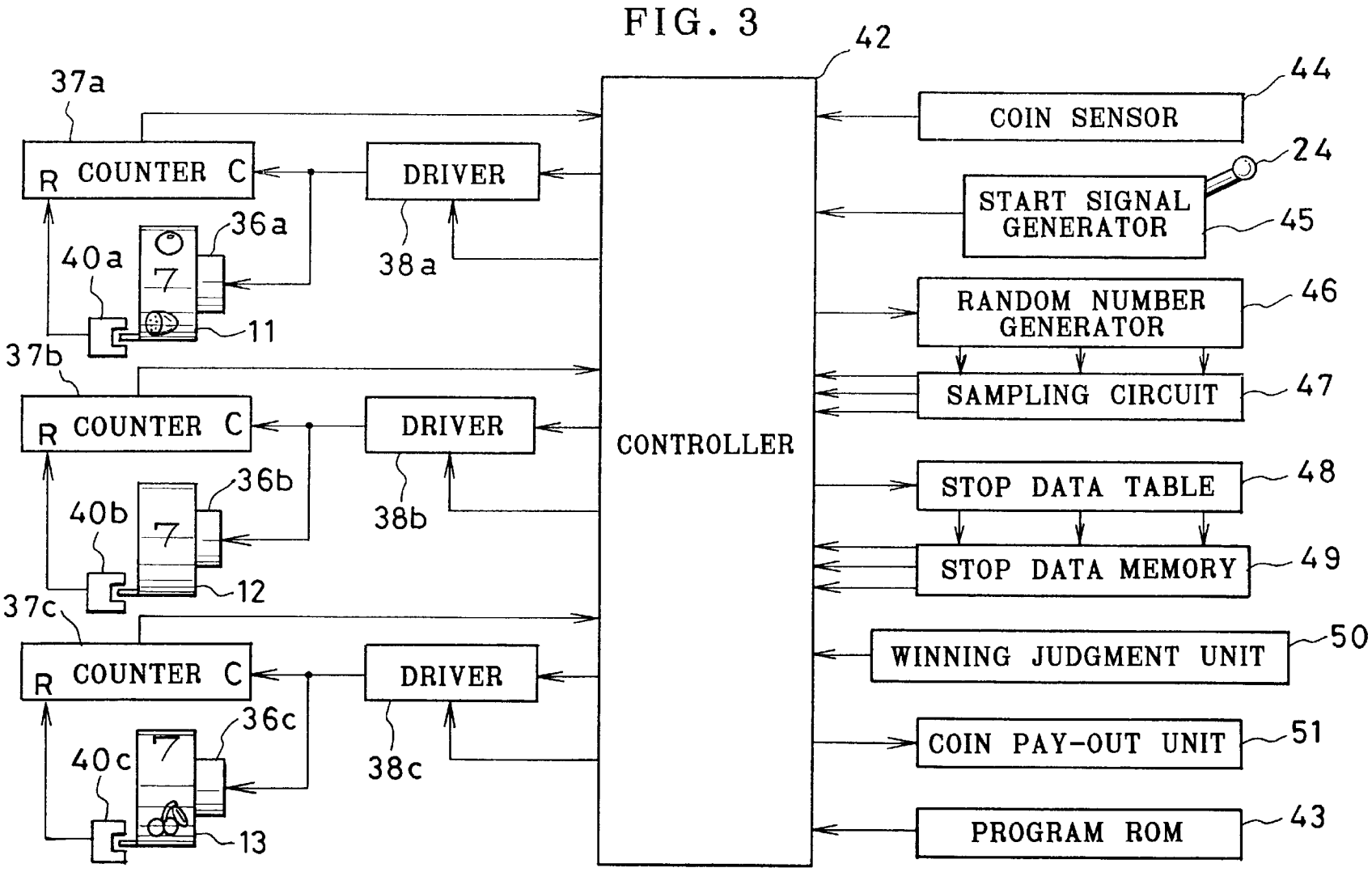
FIG. 3 is a block diagram showing an electrical structure of the slot machine in FIG. 2.

FIG. 3 shows a schematic electrical structure of the slot machine. The reels 11 to 13 are directly driven by the step motors 36*a* to 36*c* respectively. Counters 37*a*, 37*b* and 37*c* corresponding to each of the step motors are provided and count the number of drive pulses supplied to drivers 38*a*, 38*b* and 38*c*. Each of the drivers 38*a* to 38*c* is provided with reset terminal "R" besides count terminal "C". While each of the reels 11 to 13 makes a rotation, each of photo-interrupters 40*a*, 40*b* and 40*c* detects the light-shielding tab provided on each reel. The light-shielding tab is similar to that shown in FIG. 4. Counted values of the counters 37*a*, 37*b* and 37*c* are respectively reset to zero by each reset signal obtained from the photo-interrupter 40*a* to 40*c*.

A controller 42 controls the whole game sequence according to a game program written in a program ROM 43. The controller 42 controls stopping of the reels 11 to 13. In other words, the controller 42 constitutes character symbol stopping means and blank symbol stopping means. The character symbol stopping means controls stopping of the reels 11 to 13 such that the predetermined position relative to the character symbol coincides with the winning line. The blank symbol stopping means controls stopping of the reel 11 to 13 such that one of predetermined plural positions relative to the blank symbol coincides with the winning line. The controller 42 counts the number of coins put into the coin inlet 20 by a coin sensor 44 and sets the coin pay out share in case of winning. A start signal generator 45 detects an operation of the start lever 24 and inputs a start signal to the controller 42. The controller 42 activates the drivers 38*a* to 38*c* at the same time due to the start signal. Thus, drive pulses are inputted to the step motors 36*a* to 36*c* and the counters 37*a* to 37*c*.

The controller 42 inputs stop signals to the drivers 38*a* to 38*c* respectively to stop the activation thereof. Accordingly, the step motors 36*a* to 36*c* are stopped. In order to determine the input timing of the stop signal, a random number generator 46 and a sampling circuit 47 are provided. The sampling circuit 47 picks out three random numbers corresponding to three reels from among many random numbers generated by the random number generator 46 when the start lever 24 is operated. The three random numbers are inputted to the controller 42.

Upon inputting the three random numbers, the controller 42 determines the stop position of each reel referring to a stop data table 48. As described above, fourteen stop positions are set relative to each reel. Accordingly, in the stop data table 48, the random numbers, for example from 1 to 1400, generated by the random number generator 46 are divided into fourteen ranges, and data that the numbers S1 to S14 of drive pulses are allocated to each range is stored. The numbers S1 to S14 of drive pulses correspond to the positions A1 to A14 respectively. When the number of drive pulses is determined on the basis of the random number for each reel, the data regarding that is written to a stop data memory 49. By the way, generated random numbers may be set at one's discretion. Further, the range of the random numbers may be also set at one's option.

A stop control of the reels 11 to 13 is started for every reel after a proper period has passed from starting the rotation of the reels. Upon starting the stop control, the drivers 38*a* to 38*c* output the drive pulses of longer cycle due to instruction from the controller 42 to slow the rotational speed of the reels 11 to 13 down. After that, the controller 42 watches the change of the values counted by the counters 37*a* to 37*c* and inputs the stop signal to each of the drivers 38*a* to 38*c* such that the counted value of the counter coincides with the number SN of drive pulses set in the stop data memory 49. At this time, it is preferable that timing of starting the stop control for each reel is shifted so as to stop the reels 11 to 13 in order at a proper time interval.

After all of the reels 11 to 13 are stopped, the controller 42 refers to a winning judgment unit 50 to judge the presence of winning and the kind of winning based on the counted values of the counters 37*a* to 37*c*. The counted values of the counters 37*a* to 37*c* represent which symbol is stopped at the winning line 18 relative to each reel. Accordingly, by storing symbol combination data of winning and the number of coins paid out according to the winning in the winning judgment unit 50, the controller 42 may judge the presence of winning, the kind of winning and the number of paid out coins. A coin pay-out unit 51 is actuated due to instruction from the controller 42 when winning has occurred and pays out a predetermined number of coins to the tray 25 An operation of the above-described slot machine is explained hereinafter. When the start lever 24 is operated after inserting a coin or coins, the drivers 38*a* to 38*c* are activated and output the drive pulses. The step motors 36*a* to 36*c* are driven by the drive pulses so that the reels 11 to 13 are rotated at the same time. The sampling circuit 47 draws the random number for each reel when the start lever 24 is operated and inputs it to controller 42.

The controller 42 refers to the stop data table 48 and writes the number SN of drive pulses corresponding to the sampled random number to the stop data memory 49. In the stop data table 48, one hundred random numbers are allocated to each number SN of drive pulses. Namely, random numbers 1 to 100 are allocated to S1, random numbers 101 to 200 are allocated to S2 and so on, and at last, random numbers 1301 to 1400 are allocated to S14. Accordingly, the probability of selecting the specific number SN of drive pulses is 1/14. For example, when sampled random number is "412", the number "S5=52" of drive pulses is written to the stop data memory 49. Similarly, the number SN of drive pulses relative to each of the reels 12 and 13 is determined according to a sampled random number and the number SN of drive pulses is written to the stop data memory 49.

On the other hand, the drive pulses outputted from the drivers 38*a* to 38*c* are counted by the counters 37*a* to 37*c* respectively. The counted values are reset to zero every rotation of reels 11 to 13 on the basis of signals obtained by the photo-interrupter 40*a* to 40*c*. Therefore, each counted value of the counters 37*a* to a 37*c* corresponds to rotational angle of the reel.

After a lapse of proper time, stop control of the reel 11 is started. Upon starting the stop control, the driver 38*a* outputs drive pulses of longer cycle so that rotation of the reel 11 is slowed down. At the same time, the controller 42 watches the counted value of the counter 37*a* and inputs the stop signal to the driver 38*a* to stop the activation thereof when the counted value coincides with the number "S5=52" of the drive pulses written in the stop data memory 49. Accordingly, the drive pulses are not outputted after that and the step motor 36*a* is stopped so that the counted value of the counter 37*a* is fixed at "52".

When the step motor 36*a* is stopped in such a manner, the reel 11 is stopped in a state that the position A5 coincides with the winning line 18. Fourteen stop positions are set for the reel 11 so that the probability of each stop position is 1/14. Accordingly, the number of a stop positions of physical reel coincides with the number of stop positions determined by software on the basis of the random number. Namely, the appearance probability of a specific symbol determined by software coincides with that of a physical reel. When the reel 11 is stopped at the position A5 as described above, the center of the blank symbol 32 is not stopped at winning line 18. However, the gap from the center of the blank symbol is hardly noticeable unlike character symbols so that unnatural feeling is not given to the player.

Similarly, stop control for each of reels 12 and 13 is performed. When all reels are stopped, the controller 42 carries out winning judgment referring to data of the winning judgment unit 50. As the reel 11 is stopped in a state that blank symbol 32 appears at the winning line 18, the game is lost if any character symbol is stopped at the winning line 18 with respect to each of reels 12 and 13. If a predetermined combination of the character symbols 33 appears at the winning line 18 when all reels 11 to 13 are stopped, winning is obtained. In this case, the coin pay-out unit 51 is actuated to pay out coins to the tray 25. The number of coins paid out is different according to kind of winning.

In the above-described embodiment, three stop positions are set f or the blank symbol, but two stop positions may be set for the blank symbol. Further, four or more stop positions may be set for the blank symbol. However, when many stop positions are set, the gap between the center of blank symbol and the winning line becomes large when the blank symbol is stopped at end side position thereof. In such a case, an adjacent character symbol is stopped closely to the winning line 18. Therefore, it is preferable to set a maximum of five or six stop positions. The stop positions of the blank symbol may be changed by changing the number of drive pulses stored in the stop data table 48.

When only one symbol relative to each reel is displayed at the symbol display window, the winning line may be omitted. Further, the present invention may be applied to a slot machine in which three symbols relative to each reel are displayed at a symbol display window and five winning lines constituted of three horizontal lines and two diagonal lines are provided. Of course, the present invention is not exclusive for a slot machine having three reels and may be applied to slot machines in which four or more reels are arranged side by side, or reels are arranged in a matrix.

The control device for stopping a reel according to the present invention may be utilized for a pinball machine, a bingo game machine and so on. Moreover, the control device may be utilized for a video-type game machine in which image of reels are displayed on a CRT or a liquid crystal display panel on the basis of graphic data.

In the above-described embodiment, the reel is stopped by controlling the step motor. However, the reel may be stopped by engaging a lock member with an engaging portion provided on the reel. The lock member is actuated by a solenoid or the like. The engaging portion is, for example, a engaging hole or a engaging claw provided every stop position of the reel. In this case, as to the character symbol, the engaging portion is formed so as to stop the center of the character symbol at the winning line. And as to the blank symbol, a plurality of engaging portions are formed for the blank symbol. Operation timing of the lock member may be determined in accordance with the engaging portions.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A control method for stopping a reel having a plurality of symbols of equal pitch arranged on an outer periphery thereof, each of said symbols being one of a character symbol and a blank symbol having plural predetermined blank stop positions, and said reel being stopped after rotation thereof so as to overlap one of said symbols with a winning line of a symbol display window, said control method comprising:

controlling stop of said reel such that a predetermined character stop position of one said equally pitched character symbol coincides with said winning line; and controlling stop of said reel such that one of the plural predetermined blank stop positions of one said equally pitched blank symbol coincides with said winning line.

2. A control method for stopping a reel according to claim 1, wherein said predetermined character stop position is substantially centered in said character symbol.

3. A control method for stopping a reel according to claim 2, wherein said plural predetermined blank stop positions are located at a center portion of said blank symbol.

4. A control method for stopping a reel according to claim 3, wherein said plural predetermined blank stop positions are selected from a group of positions consisting of a center of said blank symbol and two positions slightly shifted from said center of said blank symbol.

5. A control device for stopping a reel having a plurality of symbols of equal pitch arranged on an outer periphery thereof, each of said symbols being one of a character symbol and a blank symbol having plural predetermined blank stop positions, and said reel being stopped after rotation thereof so as to overlap one of said symbols with a predetermined line of a symbol display window, said control device comprising:

character symbol stopping means for controlling stop of said reel such that a predetermined character stop position of said one said equally pitched character symbol coincides with said predetermined line; and blank symbol stopping means for controlling stop of said reel such that one of said plural predetermined blank stop positions of one said equally pitched blank symbol coincides with said predetermined line.

6. A control device for stopping a reel according to claim 5, wherein said predetermined character stop position of said character symbol is substantially centered in said character symbol.

7. A control device for stopping a reel according to claim 5, wherein said plural predetermined blank stop positions of said blank symbol are in a center portion of said blank symbol.

8. A control device for stopping a reel according to claim 5, further comprising a step motor for rotating said reel.

9. A control device for stopping a reel according to claim 8, wherein said character symbol stopping means and said blank symbol stopping means stop said based on a number of drive pulses supplied to said step motor.

10. A control device for stopping a reel according to claim 9, wherein said character symbol stopping means and said blank symbol stopping means stop said reel according to a random number generated by a random number generator.

11. A control device for stopping a reel according to claim 5, wherein said line is a winning line represented on said symbol display window.

12. The device of claim 5, wherein a total number of said character stop and blank stop positions exceeds a total number of said equally pitched symbols.

13. A control device for a gaming machine, the device comprising:

a rotatable reel having plural equally spaced symbols thereon, said reel for being stopped so that one of said symbols is displayed on the machine, said equally spaced symbols being one of a character symbol that has one substantially centered character stop position and a blank symbol that has plural blank stop positions in a center portion of said blank symbol, wherein a total number of said character stop and blank stop positions exceeds a total number of said equally spaced symbols; and a controller for stopping rotation of said reel so that one of said symbols is displayed substantially centered.

14. The device of claim 13, wherein each said blank symbol abuts two said character symbols.

* * * * *